US006883730B2

(12) United States Patent
Eberspach et al.

(10) Patent No.: US 6,883,730 B2
(45) Date of Patent: Apr. 26, 2005

(54) ATOMIZING NOZZLE FOR A BURNER

(75) Inventors: Günter Eberspach, Wolfschlugen (DE); Walter Blaschke, Deizisau (DE); Michael Humburg, Göppingen (DE); Franz Joos, Hamburg (DE)

(73) Assignee: J. Eberspächer GmbH & Co. KG, Esslingen (DE)

( * ) Notice: Subject to any disclaimer, the term of this patent is extended or adjusted under 35 U.S.C. 154(b) by 174 days.

(21) Appl. No.: 10/361,301

(22) Filed: Feb. 10, 2003

(65) Prior Publication Data

US 2003/0150932 A1 Aug. 14, 2003

(30) Foreign Application Priority Data

Feb. 11, 2002 (DE) ..... 102 05 573

(51) Int. Cl.[7] ..... B05B 7/10

(52) U.S. Cl. ..... 239/403; 239/405; 239/406; 239/422; 239/424; 60/737; 60/748; 431/284; 431/354

(58) Field of Search ..... 239/400, 403–406, 239/422, 424, 428, 100; 60/286, 737, 748; 431/284, 354

(56) References Cited

U.S. PATENT DOCUMENTS

| | | | | |
|---|---|---|---|---|
| 3,703,259 A | * | 11/1972 | Sturgess et al. | 239/400 |
| 4,505,106 A | * | 3/1985 | Frankenberg et al. | 60/286 |
| 4,653,278 A | * | 3/1987 | Vinson et al. | 60/737 |
| 5,647,538 A | | 7/1997 | Richardson | |
| 6,164,554 A | * | 12/2000 | Pfister et al. | 431/73 |
| 6,189,314 B1 | | 2/2001 | Yamamoto et al. | |
| 6,244,051 B1 | | 6/2001 | Zarzalis et al. | |
| 6,764,302 B1 | * | 7/2004 | Eberspach et al. | 431/284 |

FOREIGN PATENT DOCUMENTS

| | | |
|---|---|---|
| EP | 0 660 038 A2 | 6/1995 |
| EP | 0 910 776 B1 | 4/1999 |

* cited by examiner

*Primary Examiner*—Steven J. Ganey
(74) *Attorney, Agent, or Firm*—McGlew and Tuttle, P.C.

(57) ABSTRACT

An atomizing nozzle for a burner, especially for a vehicle heater has a flow guide element (16), which provides a flow guide surface (28) and which has an atomizing lip (36) in an end area (34). A fuel feed device (52, 50) is provided for feeding fuel to the flow guide surface (28) at a spaced location from the atomizing lip (36). Provisions are made for the fuel feed device (52, 50) in the flow guide element (16) to comprise a fuel release depression (50), into which opens a fuel feed channel device (52) in a junction area.

20 Claims, 6 Drawing Sheets

ATOMIZING NOZZLE FOR A BURNER

FIELD OF THE INVENTION

The present invention pertains to an atomizing nozzle for a burner, especially for a vehicle heater, comprising a flow guide element, which provides a flow guide surface and which has an atomizing lip in an end area, as well as a fuel feed device for feeding fuel to the flow guide surface at a spaced location from the atomizing lip.

BACKGROUND OF THE INVENTION

An atomizing nozzle as used in combustion chambers of gas turbines used as aircraft engines is known from EP 0 910 776 B1. The air stream entering the gas turbine is split in this prior-art atomizing nozzle. Part of the air fed in is introduced into an atomizing nozzle in the form of an outer swirling flow and an inner swirling flow. A flow guide element separates the outer swirling flow from the inner swirling flow and also forms, in particular, a flow guide surface, which ends in an atomizing lip in an axial end area of the flow guide element, for the inner swirling flow. The fuel is injected by an injection nozzle arranged centrally in relation to the flow guide element onto the above-mentioned flow guide surface through the inner swirling flow moving along the said flow guide surface and it then moves along the said flow guide surface in the direction of the atomizing lip. When the fuel film formed by injection on the flow guide surface for the inner swirling flow reaches the atomizing lip, it is atomized by the shear flow present in the area of the atomizing lip. Together with the combustion air fed in by the outer swirling flow and the inner swirling flow, the atomized fuel flows into the combustion chamber, where it is also burned while combining with the air led first past the atomizing nozzle.

SUMMARY OF THE INVENTION

The object of the present invention is to provide an atomizing nozzle for a burner as can be used especially in a vehicle heater, which leads to improved combustion of the fuel introduced.

According to a first aspect of the present invention, this object is accomplished by an atomizing nozzle for a burner, especially for a vehicle heater, comprising a flow guide element, which provides a flow guide surface and which has an atomizing lip in an end area, as well as a fuel feed device for feeding fuel to the flow guide surface at a spaced location from the atomizing lip.

Provisions are, furthermore, made according to the present invention for the fuel feed device in the flow guide element to have a fuel release depression, into which opens a fuel feed channel device in a junction area.

By feeding the fuel directly onto the flow guide surface in the atomizing nozzle according to the present invention while avoiding passing the fuel being fed through the air flowing along the flow guide surface, markedly better quality of the fuel atomization is achieved, because it can be avoided that fuel particles are carried during their passage by the air flowing through the atomizing nozzle without being led over the flow guide surface to the atomizing lip. More uniform distribution of the fuel to be atomized on the flow guide surface can also be achieved in this manner in the area located in front of the atomizing lip.

To make the distribution of the fuel to be atomized onto the flow guide surface even more uniform, it is proposed that at least one fuel distribution element be provided in the fuel release depression for delivering fuel being fed into the fuel release depression by means of the fuel feed channel device to areas of the fuel release depression that are located farther away from the junction area. Provisions may be made here, e.g., for the fuel distribution element to be designed with the utilization of the capillary effect to deliver the fuel.

A capillary flow can be achieved, using even comparatively insensitive components or materials, e.g., by the fuel distribution element defining a capillary flow channel device in cooperation with a surface area defining the fuel release depression in the flow guide element.

Furthermore, it is proposed that the fuel distribution element have at least one fuel passage area to make possible the discharge of the fuel from the fuel release depression. The fuel distribution element may comprise at least one elongated element, e.g., one made of wire material, extending along the fuel release depression. In addition, it is possible in an advantageous variant for the fuel distribution element to have a plurality of elongated elements that are located adjacent to one another and form a capillary flow channel device between them. The individual elongated elements, which can be considered to be strands of a composite of an, e.g., braided design, inherently form, especially if they have a round cross section, very fine channels between them, via which the fuel can then be delivered away from the junction area.

As an alternative, it is also possible for the at least one fuel distribution element to be formed from a porous material.

The junction area preferably has at least one junction site, at which a fuel feed channel section of the fuel feed channel device opens into the depression. To allow a certain predistribution to take place here, it is, of course, possible to provide a plurality of junction sites distributed along the fuel release depression.

It is proposed, furthermore, that the junction area be provided in a bottom area of the fuel release depression that defines the fuel release depression essentially radially. To impart a certain flow component in the longitudinal direction of the fuel release depression during its introduction into the fuel release depression and thus to further improve the distribution of the fuel over the length of the fuel release depression, it is proposed that the fuel feed channel device comprise at least one fuel feed channel section opening essentially tangentially into the fuel release depression having a ring-like or ring segment-like design.

Provisions may be made in an embodiment of the atomizing nozzle according to the present invention that is especially preferred for fluidic reasons for the flow guide element to be essentially concentric to a central axis and for the fuel release depression to be designed as an annular groove-like depression arranged essentially concentrically to the central axis.

To make it possible to atomize the fuel fed in via the atomizing nozzle according to the present invention utilizing shear flows, it is proposed that the flow guide element separate an outer swirling flow from an inner swirling flow and that the flow guide surface be a surface of the flow guide element guiding the inner swirling flow. Provisions may be made, e.g., for the flow guide element to be surrounded in an axial end area of the flow guide element that provides the atomizing lip by an outer flow guide element guiding the outer swirling flow together with the flow guide element. Furthermore, provisions are made concerning the guiding of the inner swirling flow for the flow guide element to surround at least in some areas an inner flow guide element guiding the inner swirling flow together with it and for the fuel release depression to be provided at least partially in an area of the flow guide element surrounding the inner flow guide element.

Provisions may be made in another, especially advantageous embodiment of the atomizing nozzle according to the present invention for feeding the total amount of combustion air used to burn the fuel atomized by means of the atomizing nozzle by the outer swirling flow and the inner swirling flow. It can be achieved in this manner that the combustion taking place in a burner having an atomizing nozzle according to the present invention takes place with excess air, i.e., in a lean range in the entire combustion chamber. Besides the fact that a very large amount of air can thus be used for the atomization, a reduction in the $NO_x$ emission is achieved due to the total amount of combustion air being sent through the atomizing nozzle. It shall be pointed out here that if a plurality of atomizing nozzles are to be provided in a burner according to the present invention, the outer and inner swirling flows of all atomizing nozzles are obviously to be understood in this sense, in general, to be the outer swirling flow and the inner swirling flow, which in turn means that the total amount of air used for the combustion is introduced into a burner distributed over the different atomizing nozzles.

Another advantageous aspect of the atomizing nozzle according to the present invention is that an igniting member is provided in same for igniting a combustion air-fuel mixture in a volume area defined at least partially by the flow guide element.

According to another aspect of the present invention, the object mentioned in the introduction is accomplished by means of an atomizing nozzle for a burner, especially for a vehicle heater, comprising a flow guide element, which provides a flow guide surface and which has an atomizing lip in an end area, wherein the flow guide element separates an outer swirling flow from an inner swirling flow, as well as a fuel feed device for feeding fuel to the flow guide surface at a spaced location from the atomizing lip.

Provisions are now made according to the present invention for the total amount of combustion air used for the combustion of the fuel atomized by means of the atomizing nozzle to be fed in by the outer swirling flow and the inner swirling flow.

As was explained above, this device leads, on the one hand, to the advantage of improved atomization, because a larger amount of air can be used than in the case in which only part of the air necessary for the combustion flows through an atomizing nozzle or a plurality of atomizing nozzles. Furthermore, improved combustion and consequently a reduced pollutant emission are also achieved by the improved mixing of the atomized fuel with the air fed in.

According to another aspect of the present invention, the present invention provides for an atomizing nozzle for a burner, especially for a vehicle heater, comprising a flow guide element, which provides a flow guide surface and which has an atomizing lip in an end area, as well as a fuel feed device for feeding fuel to the flow guide surface at a spaced location from the atomizing lip.

Furthermore, an igniting member for igniting a combustion air-fuel mixture in a volume area defined at least partially by the flow guide element is provided in this atomizing nozzle.

This embodiment of an atomizing nozzle according to the present invention leads to the advantage of accelerated ignition process, with the consequence that the pollutant emission can be reduced especially during the ignition process. Provisions may me made here, e.g., for the flow guide element to separate an outer swirling flow from an inner swirling flow and for the igniting member for igniting the combustion air-fuel mixture to act in a central backflow area formed in the inner swirling flow.

Furthermore, the present invention pertains to a vehicle heater, which has a burner with an atomizing nozzle according to the present invention, or to a device for the heat treatment of an exhaust gas aftertreatment system, especially for the thermal regeneration of a particle filter and/or for heating a catalytic converter, which said device has a burner equipped with an atomizing nozzle according to the present invention, which said burner preferably is or can be positioned in the exhaust gas stream. Furthermore, the present invention pertains to a device for generating process gases from liquid fuels, e.g., gasoline, diesel fuel, heating oil, methyl alcohol, ethyl alcohol, which said device has a burner equipped with an atomizing nozzle according to the present invention.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 8 is a schematic longitudinal sectional view of an atomizing nozzle according to the present invention, which shows especially the design and the action of the central flow guide element;

DESCRIPTION OF THE PREFERRED EMBODIMENTS

Figure 1:
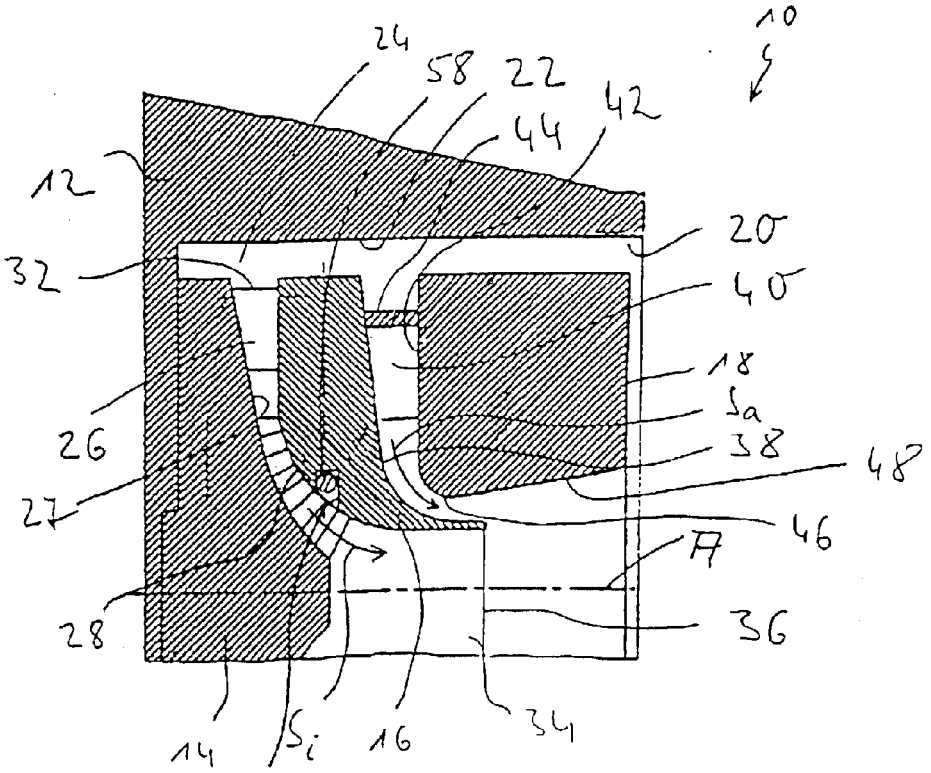
FIG. 1 is a partial longitudinal sectional view of an atomizing nozzle according to the present invention.

Referring to the drawings in particular, FIG. 1 shows a partial longitudinal section of an atomizing nozzle 10 according to the present invention. According to an advantageous aspect of the present invention, such an atomizing nozzle 10 may be used in a heating burner for a vehicle heater, e.g., a parking heater or auxiliary heater. Furthermore, it is possible to use such an atomizing nozzle 10 in a burner as is used for the regeneration of particle filters in waste gas systems, e.g., exhaust systems.

The atomizing nozzle 10 according to the present invention comprises a nozzle body 12, which is or can be fixed, e.g., on a wall of the burner. Essentially three inserts 14, 16, 18, which will be described hereinafter in detail, are arranged in the nozzle body 12. The inserts 14, 16, 18 are arranged in an opening 20 of the nozzle body 12 such that an intermediate space 24 for feeding combustion air by means of a blower is formed in the radially outer area of the inserts 14, 16, 18 to a wall 22 of the nozzle body 12, which said wall surrounds the inserts.

Figure 2:
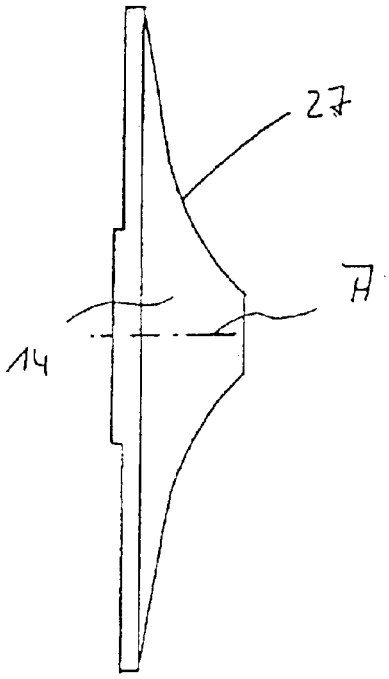
FIG. 2 is a side view of a bottom element that is used in the atomizing nozzle according to FIG. 1 and acts as an inner flow guide element.
Figure 3:
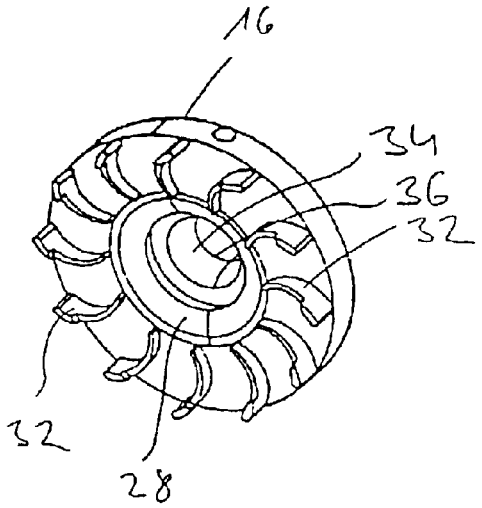
FIG. 3 is a perspective view of a central flow guide element of the atomizing nozzle shown in FIG. 1.

The insert 14, which is also shown in its entirety in FIG. 2, forms a bottom element or an inner flow guide element, which defines a flow space area 26 for an inner swirling flow to be described below together with the insert 16, which is to be considered to be a central flow guide element. As can be recognized in FIG. 2, the insert or inner flow guide part 14 is rotationally symmetrical to a longitudinal central axis A of the atomizing nozzle 10 and provides a rotationally symmetrical flow guide surface 27, which leads from radially outside to radially inside and is truncated-cone shaped, aside from its curvature. The insert or central flow guide element 16 joining the insert 14 axially correspondingly provides a flow guide surface 28 which is located opposite the flow guide surface 27 of the inner flow guide element 14 and defines together with same the flow space 26 for the inner swirling flow. To impart the necessary swirl to the combustion air entering the flow space area 26 from the radially outer intermediate space 24 in the radially inward direction due to the delivery effect of the blower, not shown, a plurality of helix section-like flow deflecting elements 32 are provided at the central flow guide element 16 on its side facing the flow guide surface 27 of the inner flow guide element 14. These flow deflecting elements 32 lie at the flow guide surface 27 of the inner flow guide element 14 to avoid flow losses. The flow space area 26 for the inner swirling flow is thus divided into a plurality of flow sections following each other in the circumferential direction.

In an approximately cylindrical end area 34 located at a spaced location from the inner flow guide element 14, the central flow guide element 16 has an atomizing lip 36, which is ring-like because of the symmetry of the central flow guide element 16 to the longitudinal central axis A. This means that the flow guide surface 28 of the central flow guide element 16, by which the inner swirling flow is defined in the radially outward direction, also ends at this atomizing lip 36.

Figure 6:
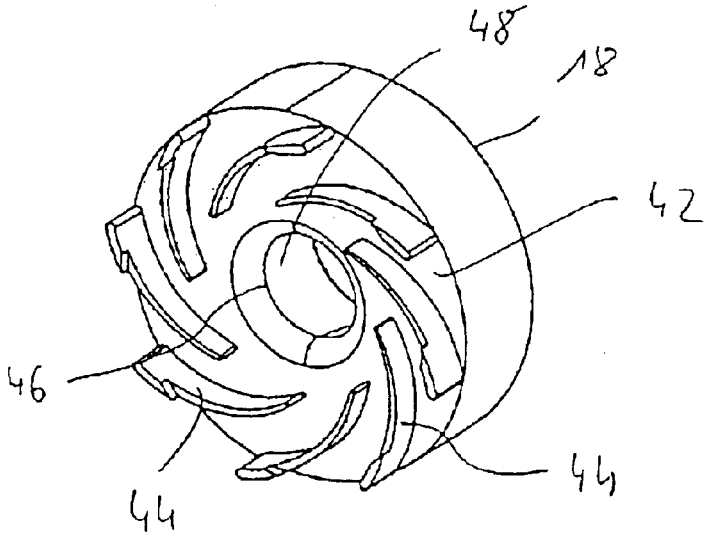
FIG. 6 is a perspective view of an outer flow guide element of the atomizing nozzle shown in FIG. 1.
Figure 7:
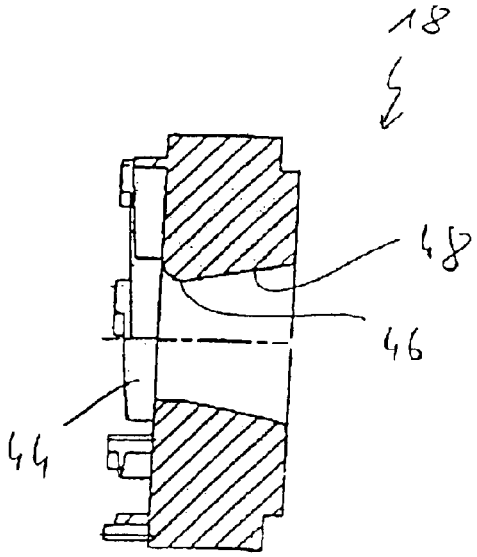
FIG. 7 is a longitudinal sectional view of the outer flow guide element shown in FIG. 6.
Figure 6:
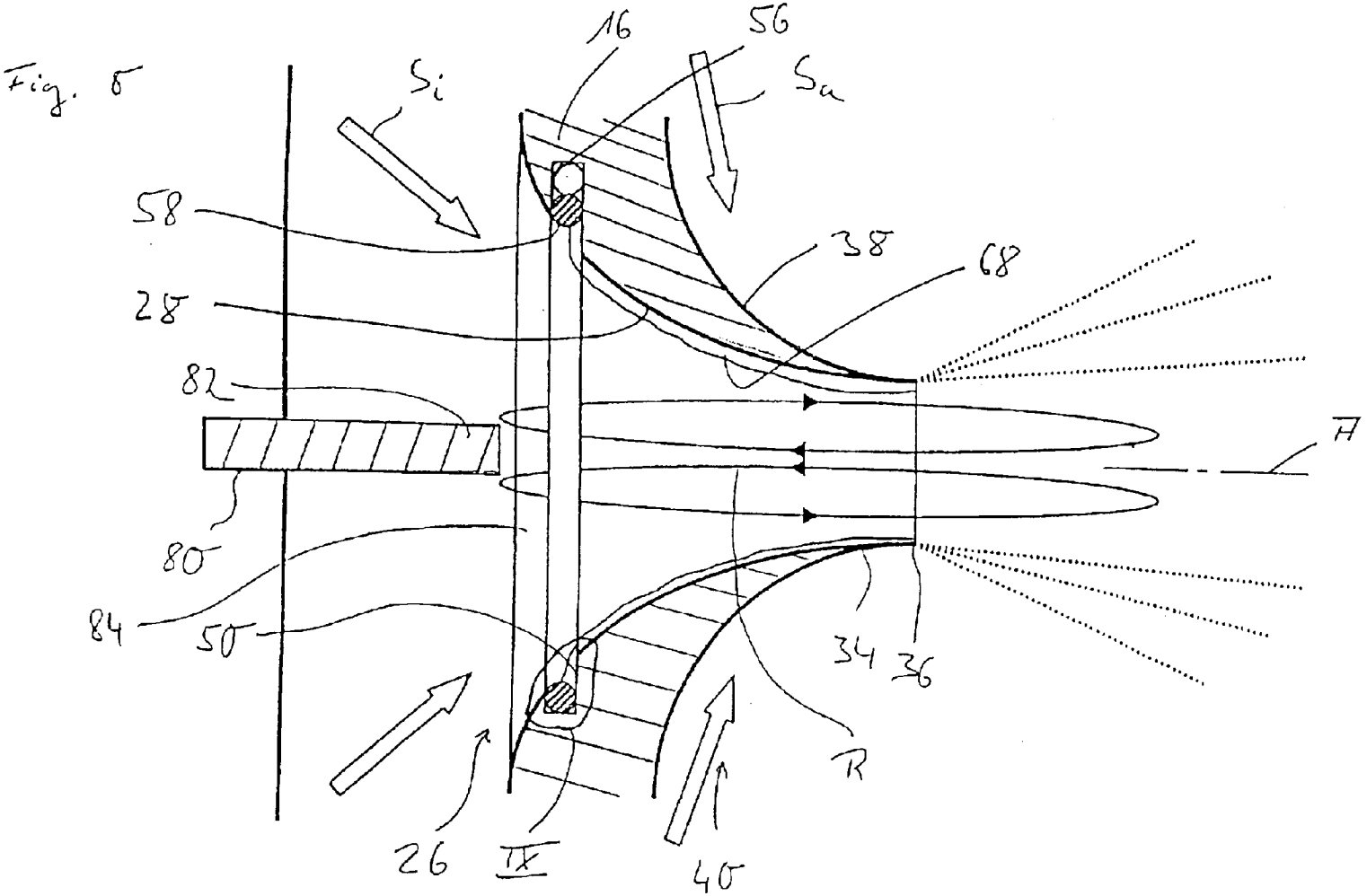

On its other axial or radial side, i.e., on the side located opposite the flow guide surface 28, the central flow guide element 16 forms an additional flow guide surface 38 for an outer swirling flow. A flow space area 40 for the outer swirling flow is defined between the flow guide surface 38 of the central flow guide element 16 and a flow guide surface 42 of the insert 18, which is to be considered to be an outer flow guide element, the flow guide surface 42 being located opposite the flow guide surface 38. In the area of its flow guide surface 42, the outer flow guide element 18, which is shown in greater detail in FIGS. 6 and 7, has a plurality of flow deflecting elements 44, which likewise have a helix section-like design and are arranged following each other in the circumferential direction. In the assembled state, these flow-deflecting elements 44 are in contact with the flow guide surface 38 of the central flow guide element 16 on their side located away from the flow guide surface 42 and thus define a plurality of sections of the flow space area 40 following each other in the circumferential direction for the outer swirling flow in cooperation with the two flow guide surfaces 38, 42. The outer flow guide element 18 forms a vertex area 46 of the flow guide surface 42, in which this surface has the smallest diameter in relation to the longitudinal central axis A. This vertex area 46 is located upstream of the atomizing lip 36. Furthermore, this vertex area 46 is joined by a diffuser area 48, which will then expand in the direction of flow.

Consequently, the flowing air, which is fed in through the space area 24 from the radially outward direction under the action of the above-mentioned blower and is then split into the two flow space areas 26, 40, flows in the form of the inner swirling flow $S_i$ and the outer swirling flow $S_a$ from the radially outward direction in the radially inward direction and thus enters the area of the atomizing lip 36 from both sides, i.e., from the outside and from the inside. Predetermined by the geometry of the flow deflecting elements 32, 44, these two swirling flows $S_i$ and $S_a$ may have the same direction of rotation or an opposite direction of rotation in relation to one another. These two swirling flows $S_i$ and $S_a$ will then meet each other in the area of the atomizing lip 36 and lead to the atomization of the combustion air, which is likewise fed to the atomizing lip 36, as is described especially in reference to FIGS. 8 through 10.

Figure 4:
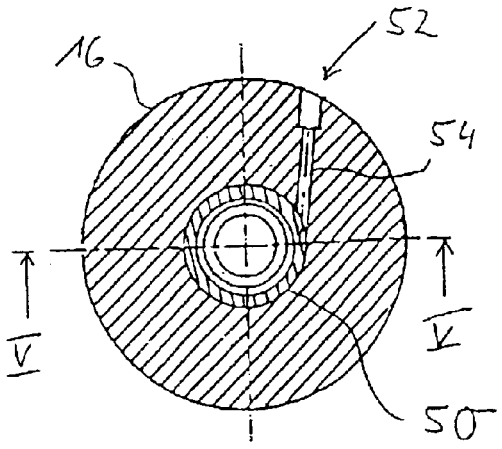
FIG. 4 is a cross-sectional view of the central flow guide element shown in FIG. 3, cut in the plane IV—IV in FIG. 5.
Figure 5:
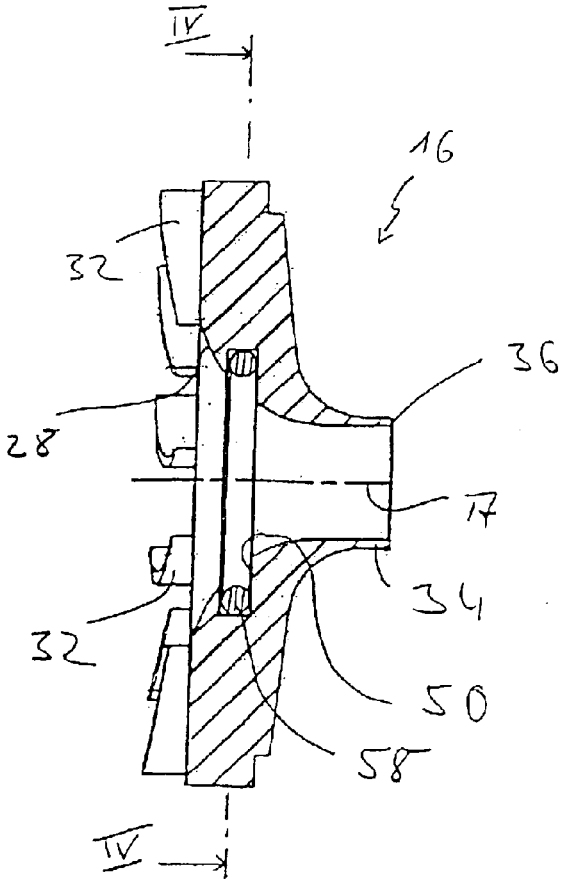
FIG. 5 is a longitudinal sectional view of the central flow guide element shown in FIG. 3, cut in a plane V—V in FIG. 4.

It can be recognized from FIG. 8 that an annular groove-like depression 50, which is circular around the longitudinal central axis A in the example being shown, is formed in the central flow guide element 16 in the area of the flow guide surface 28. This deepening or depression 50, which provides a fuel release depression, may be prepared, e.g., by machining, but it may also be obtained by joining the central flow guide element 16 from two correspondingly shaped components that together form the depression 50. As can also be recognized especially in FIG. 4, this depression 50 opens into a fuel feed channel device generally designated by 52. In the example being shown, this comprises a fuel feed channel section 54, which extends essentially tangentially to the ring-like depression 50 and opens into the bottom area 56 of the depression 50. Furthermore, a fuel distribution element 58, which is made of wire ring or a ring 59 made of another material in the example being shown, is provided in the depression 50. In the areas of the depression 50 into which no fuel feed channel section 54 opens, this fuel distribution element 58 is in contact with both the bottom area 56 and the two side walls 60, 62 that essentially define the depression 50 together with the bottom area 56. Small intermediate spaces may optionally also be formed here. As was explained above, the fuel distribution element 58 may be designed, e.g., as an open wire ring 59 to facilitate insertion, in which case the longitudinal dimension is such that the two end areas are located flush opposite each other and optionally leave only a small intermediate space. As can be recognized in FIGS. 9 and 10, the fuel distribution element 58 has openings 64 in a plurality of positions. As can be recognized especially in FIG. 9, these openings 64 establish a connection in a plurality of circumferential positions to channel areas 66 that are defined by the fuel distribution element 58 and the surfaces defining the depression 50, i.e., essentially the walls 60, 62 and the bottom area 56.

Consequently, as was mentioned above, the fuel is supplied via at least one fuel feed channel section 54 of the fuel feed channel device 52 into the area of the bottom area 56. The fuel optionally enters the channel areas 66 under an admission pressure. In case of corresponding dimensioning, which may also be coordinated with the viscosity of the fuel being used, the fuel present in the channel areas 66 may be delivered forward in the channel areas by capillary effect, so that it will also reach, e.g., the areas in which the openings 64 establish a connection with the side of the depression 50 that is open radially inwardly. At the openings 66 located distributed over the circumference, the fuel being delivered to these areas by capillary effect and optionally also by the effect of the admission pressure will then escape from the depression 50 and form, as can be recognized in FIG. 8, a fuel film 68 wetting the flow guide surface 28 in the area between the depression 50 and the atomizing lip 36 under the effect of the inner swirling flow $S_i$.

Based on the delivery effect mentioned above, the fuel is distributed very uniformly in the circumferential direction around the longitudinal central axis A in the depression 50 even if only a single fuel feed channel section 54 is provided, so that a likewise uniform wetting of the flow guide surface 28 takes place in the area thereof The consequence of this is that highly uniform fuel atomization is also achieved over the circumference of the atomizing lip 36, distributed under the effect of the two swirling flows $S_i$ and $S_a$ and the shearing action present in the area of the atomizing lip 36. The uniform atomization of the fuel leads to a likewise uniformly distributed combustion of the fuel particle-combustion air mixture thus generated. This in turn results in a combustion with very low pollutant emission, which can also be supported, especially according to another aspect of the present invention, by feeding in the total amount of fuel needed and used for the combustion of the fuel fed in, in the form of the two swirling flows $S_i$ and $S_a$. Thus, a highly efficient shearing action can be obtained and very good premixing of the fuel particles generated by the atomization with the combustion air fed in can be achieved already in the area close to the atomizing nozzle. It shall be pointed out here that the total amount of air used for the combustion is, of course, split among the different atomizing nozzles in the case of a burner that has a plurality of atomizing nozzles 10 according to the present invention, and the individual amounts of combustion air fed to the atomizing nozzles in this case are introduced into the combustion chamber completely in the form of the two swirling flows $S_i$ and $S_a$ via the atomizing nozzle 10.

Another advantage of the fuel feed according to the present invention via the groove-like depression 50 is the fact that the need to deliver the fuel fed in by one of the swirling flows to a flow guide surface is eliminated. Furthermore, the depression with the fuel distribution element 58 present therein forms a fuel reservoir, so that equalization of the release of fuel in the direction of the atomizing lip 36 can be achieved even in the case of variations in pressure or changes in the amount of fuel being fed.

Figure 11:
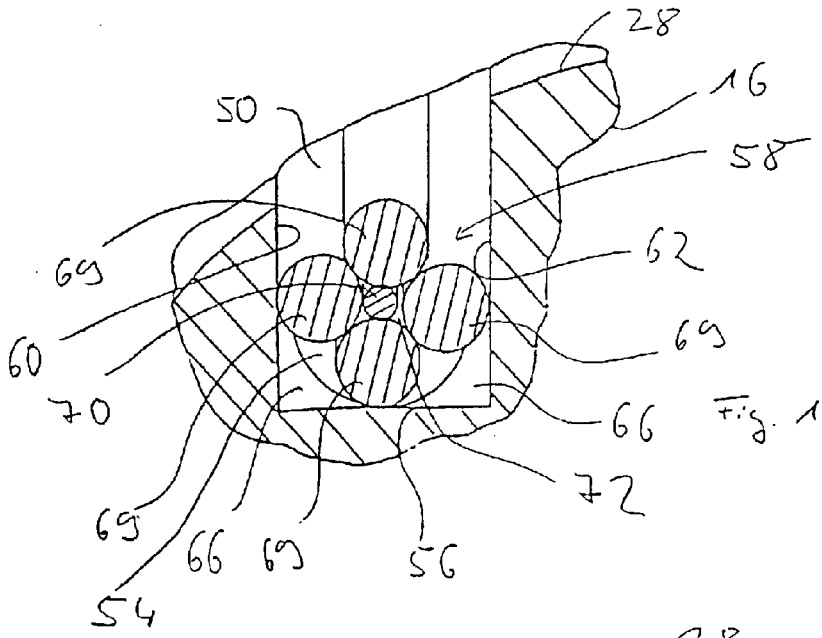
FIG. 11 is a view corresponding to FIG. 9, which shows an alternative embodiment of a fuel distribution element.

FIG. 11 shows an alternative embodiment of a fuel distribution element 58. This comprises here a plurality of strands 69, which are again formed by, e.g., a wire material, and which are wound around a core 70 in the manner of a cable or are braided. Channel areas 72, which generate a capillary effect in addition to the above-mentioned channel areas 66, are now formed between these strands 69 and optionally also between the strands and the core 70. However, a fuel distribution element 58 extending in an elongated pattern in the direction of the depression 50 extending around the longitudinal central axis A may also be provided here, in principle, and the discharge areas, via which the fuel introduced through the fuel feed channel section 54 can escape in the direction of the flow guide surface 28 after distribution, utilizing the capillary delivery effect, are already formed in this fuel distribution element because of the twisting or the braiding-like surface contour.

Figure 9:
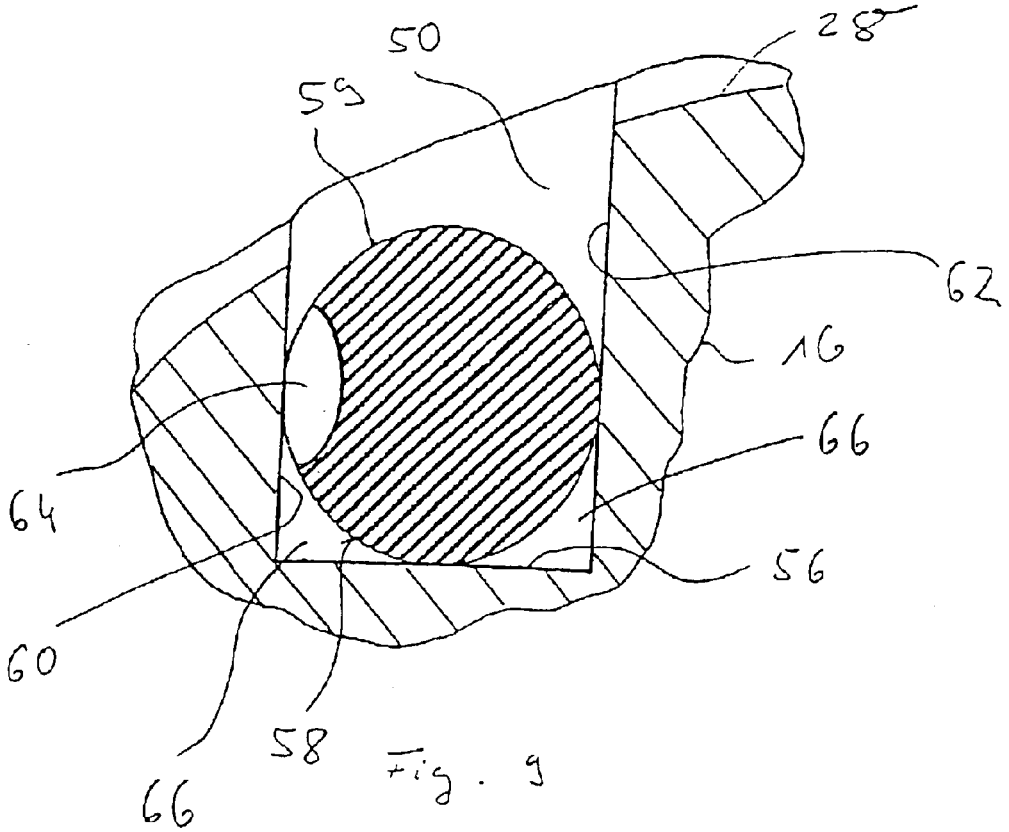
FIG. 9 is an enlarged view of detail IX in FIG. 8.
Figure 10:
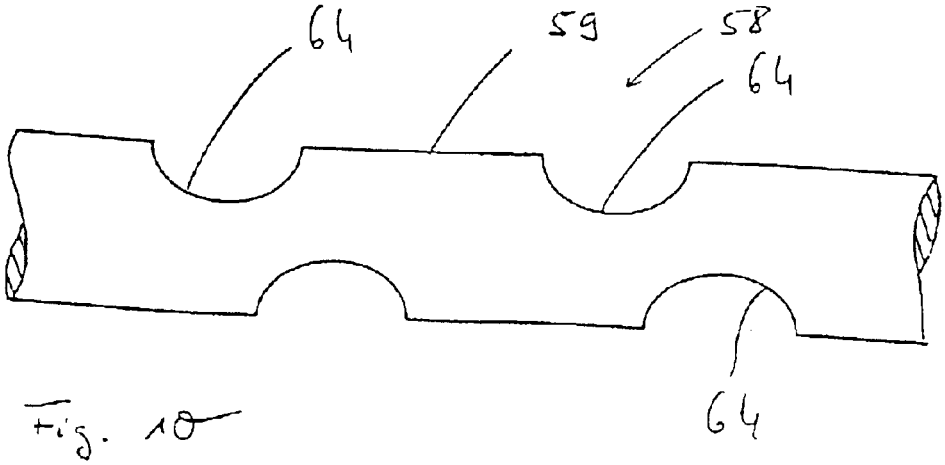
FIG. 10 is part of the fuel distribution element recognizable from FIG. 9.

It shall be pointed out here that any material suitable for this purpose, e.g., metal, fuel and heat resistant plastic, or ceramic, may be used for both the fuel distribution element 58 according to FIG. 11 and the fuel distribution element shown in FIGS. 8 and 9.

Figure 12:
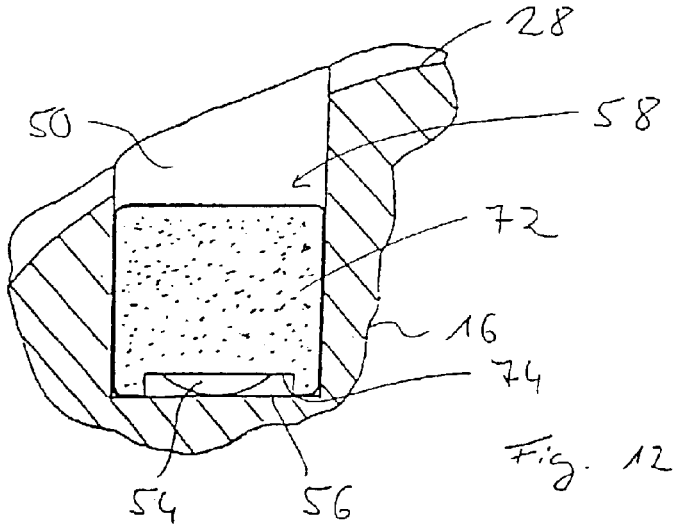
FIG. 12 is another view corresponding to FIG. 9, which shows an alternative embodiment of a fuel distribution element.

FIG. 12 shows another embodiment of a fuel distribution element 58, which is designed here as a porous body 72 that can be inserted into the depression 50. A depression 74, which is used for the predistribution under pressure of the fuel introduced through the fuel feed channel section 54, may be provided in the porous body 72 in the section facing the bottom area 56. Consequently, a predistribution may take place in the bottom area 56 here, which may also happen, of course, in the case of the embodiment according to FIG. 11. However, the release toward the flow guide surface 28 now takes place to equalize the release with the utilization of a capillary effect.

Another embodiment of a fuel distribution element, not shown, may comprise, e.g., a tubular element, which has a plurality of optionally comparatively small openings distributed in its tube wall, via which fuel that had been fed in in the area of the bottom area 56 of the depression 50 and has optionally already been predistributed can enter, on the one hand, and, on the other hand, the fuel can then again escape in the direction of the flow guide surface 28 in the section facing away from the bottom area 56.

It shall be pointed out that the depression 50 discussed above as well as the various fuel distribution elements 58 that may be provided therein do not, of course, have to be necessarily arranged in the circumferential direction around the longitudinal central axis A, even though this is highly advantageous for manufacturing technical reasons and because of the most uniform fuel release possible. The various fuel distribution elements 58 may also be composed of a plurality of segments arranged following each other in the circumferential direction in the case of a depression 50 extending, e.g., circularly in the circumferential direction as well.

Figure 13:
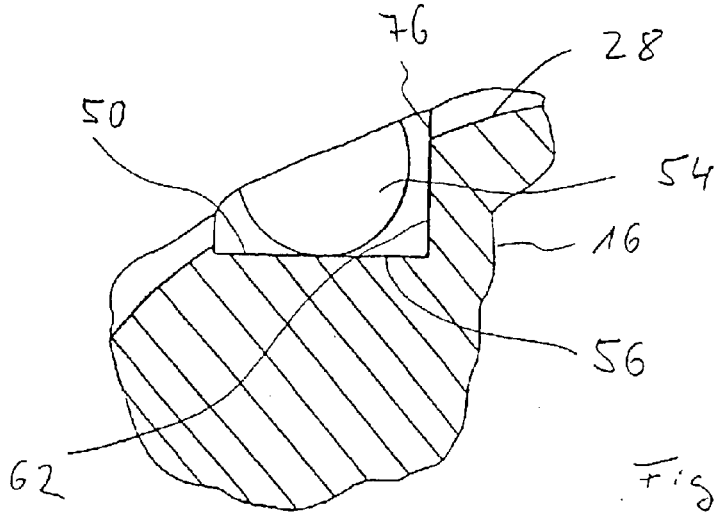
FIG. 13 is another view corresponding to FIG. 9, which shows an alternative embodiment of the central flow guide element.

FIG. 13 shows another embodiment of a central flow guide element 16 according to the present invention, in which the fuel is likewise fed via a groove-like depression 50 preferably extending circularly in the circumferential direction in the area of the flow guide surface 28 of the central flow guide element. A plurality of fuel feed channel sections 54 following each other in the circumferential direction preferably also open into this depression 50 in its bottom area 56. In the transition area 76 to the flow guide surface 28, the wall 62 defining the depression 50 in the downstream direction forms an edge acting as a dam, which generates a metered release of fuel from the depression 50 to the area of the flow guide surface 28 following it in the downstream direction, i.e., highly uniform release of fuel in the direction of the atomizing lip 36 can also be achieved without the use of a fuel distribution element, as was discussed above, especially if a plurality of fuel feed channel sections 54 distributed in the circumferential direction, which feed fuel into the depression 50, are provided.

Another aspect of the present invention can be recognized in FIG. 8. An igniting member 80, designed, e.g., as a glow-type ignition pin, can be recognized there in an area centered in relation to the longitudinal central axis A. This igniting member 80 is positioned such that with its end area 82 providing the temperatures necessary for the ignition, it protrudes into a volume area 84, which is defined in the radially outward direction by the central flow guide element 16 and in which a recirculation R generated because of the flow dynamics is also present. The combustion air led by the recirculation into this area, which is also arranged centrally in relation to the inner swirling flow $S_i$, already contains very fine fuel particles generated before in the area of the atomizing lip 36, so that an ignitable fuel particle-combustion air mixture enters the area of the igniting member 80 due to this recirculation R. To protect the glow-type igniting member 80 from excessive cooling because of the inner swirling flow $S_i$ flowing in at a comparatively high velocity, it is possible, e.g., to insert this igniting member 80 in the central area of the insert that can be recognized in FIGS. 1 and 2 and acts as an inner flow guide element. Furthermore, the igniting member 80 may be surrounded, especially in the end area 82, by a braiding-like or porous screening material, leaving a slight intermediate space between them. An atmosphere that is essentially screened from air flows, which possesses very good properties for the ignition, will then be generated in this intermediate space by the accumulation of fuel in the porous or braiding-like material.

In case of use in a burner of a heater, e.g., of a vehicle parking heater, the atomizing nozzle according to the present invention leads to very uniform combustion. This is due essentially to the fact that the fuel is fed highly uniformly in the direction of the atomizing lip, and that a very large amount of air, namely, essentially the total amount of air used for the combustion of the atomized fuel, is also utilized to generate the fine fuel particles. The atomizing nozzle according to the present invention may also be used in other areas, e.g., in a regenerating burner for a particle filter in exhaust gas systems of an internal combustion engine, as is disclosed, e.g., in DE 195 04 183 A1. The disclosure contents of this public disclosure document are also included by reference to the disclosure contents of this text especially in light of the design embodiment of such a regenerating burner. Another area of use of an atomizing nozzle according to the present invention or of a burner containing such an atomizing nozzle in an exhaust gas aftertreatment system is the preheating of a catalytic converter intended for exhaust gas cleaning. The burner operating now as a so-called catalytic converter burner, which may also be positioned in the exhaust gas stream, is used to bring the catalytic converter to a suitable operating temperature as rapidly as possible at the start of a vehicle engine in order to reduce the pollutant emission during the cold start phase. Another area in which the atomizing nozzle according to the present invention or a burner containing same may be used is the generation of process gases, e.g., for fuel cells, from liquid fuels, e.g., gasoline, diesel fuel, heating oil, methyl alcohol, ethyl alcohol, etc. A process gas is provided here by means of a cold flame, i.e., a flame with a comparatively low temperature, e.g., as an energy source for the drive of the vehicle, for generating electricity for onboard power supply systems of vehicles, or for generating heat in a vehicle preheater. Process gas generated in this manner may also be used in the household for both generating electricity and for home heating.

It shall be pointed out that especially the group of features relating to the fuel supply via an annular groove may also be used in an atomizing nozzle in which only one of the swirling flows, i.e., for instance, the inner swirling flow, is present, which will then flow along the associated flow guide surface and the depression provided therein and entrains the fuel fed in via the depression in the direction of the atomizing lip.

The total amount of air necessary or used for the combustion may be fed in within the framework of this single flow, which could, of course, also be the outer swirling flow. Furthermore, it is pointed out that it would also be possible to feed the fuel in the area of the flow guide surface 38 located outwardly and leading to the atomizing lip 38.

While specific embodiments of the invention have been shown and described in detail to illustrate the application of the principles of the invention, it will be understood that the invention may be embodied otherwise without departing from such principles.

What is claimed is:

1. An atomizing nozzle for a burner, the nozzle comprising:

a flow guide element providing a flow guide surface and having an atomizing lip in an end area; and a fuel feed device for feeding fuel to said flow guide surface at a spaced location from said atomizing lip, said fuel feed device being in the flow guide element and having a fuel release depression and with a fuel feed channel section opening into said fuel release depression in a junction area.

2. An atomizing nozzle in accordance with claim 1, wherein said fuel feed device includes a fuel distribution element provided in said fuel release depression for delivering fuel fed via said fuel feed channel section into the fuel release depression to areas of said fuel release depression located farther away from the junction area.

3. An atomizing nozzle in accordance with claim 2, wherein said fuel distribution element is structured for delivering the fuel utilizing a capillary effect.

4. An atomizing nozzle in accordance with claim 3, wherein the fuel distribution element defines a capillary flow channel device in cooperation with a surface area defining said fuel release depression in said flow guide element.

5. An atomizing nozzle in accordance with claim 2, wherein said fuel distribution element has at least one fuel passage area for the delivery of fuel to said fuel release depression.

6. An atomizing nozzle in accordance with claim 2, wherein said fuel distribution element has at least one elongated element extending along said fuel release depression.

7. An atomizing nozzle in accordance with claim 2, wherein said fuel distribution element has a plurality of elongated elements located next to each other and forming a capillary flow channel device between them.

8. An atomizing nozzle in accordance with claim 2, wherein said fuel distribution element is formed from a porous material.

9. An atomizing nozzle in accordance with claim 8, wherein said junction area comprises at least one junction site, at which a fuel feed channel section of said fuel feed channel device opens into said fuel release depression.

10. An atomizing nozzle in accordance with claim 1, wherein said junction area is formed in a bottom area of said fuel release depression that defines said fuel release depression essentially radially.

11. An atomizing nozzle in accordance with claim 1, wherein said fuel feed channel device comprises at least one fuel feed channel section that opens essentially tangentially into said fuel release depression, said fuel release depression being ring-like or ring segment-like.

12. An atomizing nozzle in accordance with claim 1, wherein said flow guide element is essentially concentric to a central axis and said fuel release depression is designed as an annular groove-like depression arranged essentially concentrically in relation to a central axis.

13. An atomizing nozzle in accordance with claim 1, wherein said flow guide element separates an outer swirling flow from an inner swirling flow and said flow guide surface is a surface of said flow guide element carrying the inner swirling flow.

14. An atomizing nozzle in accordance with claim 13, further comprising an outer flow guide element, wherein the flow guide element is surrounded in an axial area providing said atomizing lip by said outer flow guide element guiding the outer swirling flow together with the flow guide element.

15. An atomizing nozzle in accordance with claim 13, further comprising an inner flow guide element, wherein said flow guide element surrounds said inner flow guide element guiding the inner swirling flow together with said inner flow guide element in at least some areas and said fuel release depression is formed at least partially in an area of said flow guide element surrounding said inner flow guide element.

16. An atomizing nozzle in accordance with claim 13, wherein a total amount of combustion air used for the combustion of fuel atomized by the atomizing nozzle is fed in by the outer swirling flow and the inner swirling flow.

17. An atomizing nozzle in accordance with claim 1, further comprising an igniting member for igniting a combustion air-fuel mixture in a volume area defined at least partially by said flow guide element.

18. A vehicle heater, comprising:

a burner with an atomizing nozzle having a flow guide element providing a flow guide surface and having an atomizing lip in an end area and a fuel feed device for feeding fuel to said flow guide surface at a spaced location from said atomizing lip, said fuel feed device being in the flow guide element and having a fuel release depression and with a fuel feed channel section opening into said fuel release depression in a junction area.

19. An exhaust gas aftertreatment system device for the thermal regeneration of a particle filter and/or for heating a catalytic converter, the device comprising:

a burner with en atomizing nozzle having a flow guide element providing a flow guide surface and having an atomizing lip in an end area and a fuel feed device for feeding fuel to said flow guide surface at a spaced location from said atomizing lip, said fuel feed device being in the flow guide element and having a fuel release depression and with a fuel feed channel section opening into said fuel release depression in a junction area.

20. Device for generating process gases from liquid fuels, comprising a burner with an atomizing nozzle having a flow guide element providing a flow guide surface and having an atomizing lip in an end area and a fuel feed device for feeding fuel to said flow guide surface at a spaced location from said atomizing lip, said fuel feed device being in the flow guide element and having a fuel release depression and with a fuel feed channel section opening into said fuel release depression in a junction area.

* * * * *